United States Patent [19]

Muller et al.

[11] 3,994,315

[45] Nov. 30, 1976

[54] CONTROL APPARATUS FOR AIR BLAST PREHEATERS OF BLAST FURNACES

[75] Inventors: Rudolf Muller, Merzenich; Johannes Uerlichs, Woffelsbach, both of Germany

[73] Assignee: Hermann Rapold & Co. GmbH, Birkesdorf, Germany

[22] Filed: Mar. 22, 1974

[21] Appl. No.: 453,983

[30] Foreign Application Priority Data

Mar. 26, 1973 Germany ..... 2314978

[52] U.S. Cl. ..... 137/601; 137/625.38; 137/625.68; 266/197

[51] Int. Cl.[2] ..... F16K 3/26

[58] Field of Search ..... 266/29, 30; 137/625.38, 137/601, 625.68, 625.3; 251/205, 325

[56] References Cited

UNITED STATES PATENTS

| | | | |
|---|---|---|---|
| 89,399 | 4/1869 | Gilbert | 137/625.38 |
| 669,284 | 3/1901 | Pelton | 137/625.68 |
| 1,675,307 | 6/1928 | Dake | 137/625.68 |
| 1,679,257 | 7/1928 | Neebe | 137/625.38 |

FOREIGN PATENTS OR APPLICATIONS

| | | | |
|---|---|---|---|
| 822,114 | 9/1937 | France | 137/625.3 |
| 626,638 | 3/1936 | Germany | 137/625.68 |
| 683,976 | 12/1952 | United Kingdom | 137/625.3 |

*Primary Examiner*—Robert G. Nilson
*Attorney, Agent, or Firm*—Anthony J. Casella

[57] ABSTRACT

In a blast preheater for a blast furnace, a control housing has at least one open ended cylinder vertically mounted therein. The cylinder, or each of several cylinders has several axially spaced rows of circumferentially spaced slots, extending through the wall of the cylinder. A slider is slidable in the cylinder for opening, restricting or closing such slots. Wall means are mounted in the housing and are so arranged that in each position of the slider, a first part of the housing surrounding at least one of said rows of slots is separated by the wall means from at least one other part of the housing which communicates with the interior of the cylinder. Separate connectors communicate respectively with the so separated parts of the housing and connect the same to different parts of the blast preheater system, such as the inlet for cold air, under pressure; the inlet for combustion gas, for starting the preheater under lower pressure; the outlet for flue gas from the preheater; and the preheater outlet connecting the hot blast to the blast furnace. One of the new control housings can be provided for each of these lines, or for several of them. The new cylinder and slider system serves to fully open or fully close the line and also to regulate the line by restricting the slots.

8 Claims, 14 Drawing Figures

CONTROL APPARATUS FOR AIR BLAST PREHEATERS OF BLAST FURNACES

BACKGROUND OF THE INVENTION

The invention relates to control apparatus of the type using a row (sometimes called a "gallery") of slots in a cylinder and slider arrangement for opening, closing, and regulating currents of gas, air, cold blast and flue gas for the air blast preheaters, also known as hot air stoves or cowpers of blast furnaces.

The hot air stove or air blast preheater supplies compressed and heated air (so called hot blast) to the blast furnace for the combustion of the heating material and for the conversion and activation of the reducing agents in the blast furnace. Regulating controls are provided in the hot blast line to regulate the amount and temperature of the hot blast and to keep such amounts and temperatures constantly at predetermined values, prior to introduction into the blast furnace, in order to keep the blast furnace operation as even and quite as possible. The blast preheaters are alternately heated up by combustion of gas, and supplied with cold blast to be converted by the preheaters into the hot blast for the blast furnace. Prior to the changeover for cold blast entering into the preheater, the preheater is filled up with air, up to a predetermined target pressure, in order to avoid any pressure drop in the cold blast duct and preheater, and accordingly in the hot blast duct from the blasting preheater, which would endanger the blast furnace operation. On the other hand, prior to the changeover from cold blasting to heating up of the preheater, air must be discharged from the preheater as the heating up is conducted at a pressure but slightly above the pressure of the atmosphere. Of course, this filling up and discharging of the preheater is to be performed as rapidly as possible, but it is also important not to disturb the supply of hot blast to the blast furnace, not to generate too much noise incident to the discharging of air from the preheater, and at the same time to keep the cost of the entire system within reasonable limits. For these purposes and others, also to maintain proper safety, large and complex control systems have been used for the preheaters, and the different parts of such control systems have been constructed in different form and dimensions, each depending on its particular function (for example, opening and closing as distinguished from regulating) and also depending on the aerostatic and aerodynamic conditions imposed on each control element. Different control elements were typically formed as slot-type valves or in other forms. As pressures, temperature and amounts of air or gas to be handled were constantly increased in blast furnace operation, the coast of the control elements and control systems tended to increase constantly. A series of control elements was needed in each of the several lines, connected to a blast preheater for performing different functions such as opening and closing the lines and regulating the filling up and discharge operations. In view of the high pressures, temperatures and quantities of flow, none of he controls as constructed and arranged up to now was suitable for performing several of these functions.

One of the control elements known to the art has used an open ended, slotted cylinder with a slider slidable therein by suitable power for fully closing, fully opening, or partly closing and partly opening the slots. Such controls were built with a housing around the cylinder and with first and second connectors, the first connector communicating with the space around the cylinder in the area of the slots and the other connector communicating with one or both of the open ends of the cylinder. Such a control element operates under balanced pressures, as the pressure of the fluid medium controlled thereby is uniformly applied to all sides of the slider and therefore does not influence the forces required for moving the slider. In addition, this type of control is not easily disturbed by changes of temperature of the fluid medium, and by resulting changes of expansion or contraction of the cylinder and slider. However, the control elements of this type, as known up to now, could be utilized only within narrow limits regarding their application to the various types and amounts of flows. For example, it was impossible to simply enlarge the total slot apertures provided by the devices built up to now, to accommodate larger amounts of flow. Even for reasons of strength of material such simple enlargement was impractical.

SUMMARY OF THE INVENTION

It is an object of the invention to overcome the limitations and difficulties encountered up to now in control apparatus of the indicated type.

It is another object to provide improved control apparatus for closing and opening and also for regulating flows of gas, cold blast, hot blast and flue gas in blast preheater systems.

It is a more particular object to provide such apparatus in such form or forms as to accommodate various amounts of flow and a multiplicty of controlling and regulating operations in a furnace blast preheating system.

Another object is to construct the apparatus so that it is simple and inexpensive to build and to operate.

For these purposes the invention provides control apparatus for air blast preheaters of blast furnaces with at least one open ended cylinder having several axially spaced rows of circumferentially spaced slots extending through the cylinder wall and having a slider slidable in the cylinder for opening, restricting or closing such slots, and with wall means mounted in a housing around the cylinder in such a way that a first part of said housing which surrounds at least one of said rows of slots, is separated by the wall means from at least one other part of the same housing which communicates with the interior of the cylinder. Separate connectors communicate respectively with the so separated parts of the housing.

By means of this construction, the above mentioned cylinder and slider construction can be utilized in blast preheater systems free of the earlier limitations regarding amounts, pressures and temperatures of the flows passing through the control elements. For example, the new control elements can be used without difficulty under the remarkably high pressures and temperatures used in the newer blast furnaces. Corresponding to the amount of flow, the new controls have a greater or lesser number of open ended cylinders with axially spaced rows of circumferentially spaced slots. Correspondingly arranged, separating walls are provided. The new control apparatus can be used for purposes of shutting off as well as regulating the various flows, under the various pressure, thereby making it unnecessary to provide the earlier multiplicity of separate control devices in series or in parallel for each of the flow lines connected with a blast preheater. All of the slotted control cylinders and sliders therein, as arranged in accordance with the invention can be constructed with the same dimensions for an entire preheater system and for all of the different lines therein. particularly the sliders can be interchanged, thereby considerably reducing the cost and simplifying the operation needed for construction, operation and storage of replacement parts.

It is preferred to construct each cylinder in the new control apparatus with two axially spaced rows of circumferentially spaced slots; to establish communication of the slots of each row to one of the connectors in the preheater system; and to establish communication for at least one of the open ends of the cylinder, through an additional connection. It is also preferred to construct the sliders so as to close all rows of slots, in one positions; and to close or regulate another row of slots in third slider positions.

the invention requires only a single drive for several sliders in each control device, and requires only little power for this single drive since the pressure are balanced and the drive must overcome only the weight of the sliders and the friction thereof in the cylinders.

For purposes of rapid shutting off of a line, the drive can include a rapid traverse motor.

Of course, it is also possible to provide a separate drive for each slider in a control device according to the invention and thereby to make it possible to perform regulating functions in particularly sensitive ways. It is nevertheless preferred to drive the several sliders of a single control device according to the invention by a single drive means.

Desired regulating characteristics can be provided by constructing the several slots of any one row of slots, or all rows of slots in a single cylinder, in different forms as to make the characteristic curve linear or nonlinear as desired.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In FIG. 5, different operating positions of the apparatus are shown in the right half and the left half of the Figure;

DESCRIPTION OF THE PREFERRED EMBODIMENTS

Figure 1:
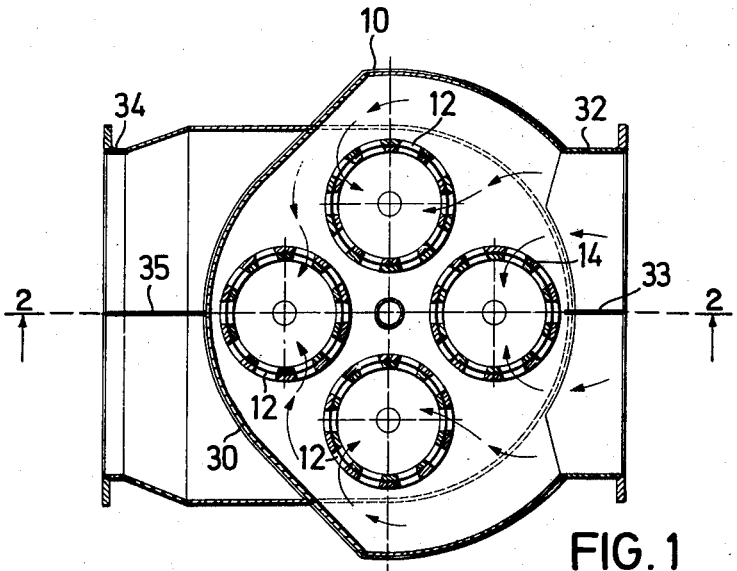
FIG. 1 shows a first embodiment of the invention in horizontal sectional view taken along line 1—1 of FIG. 2.
Figure 2:
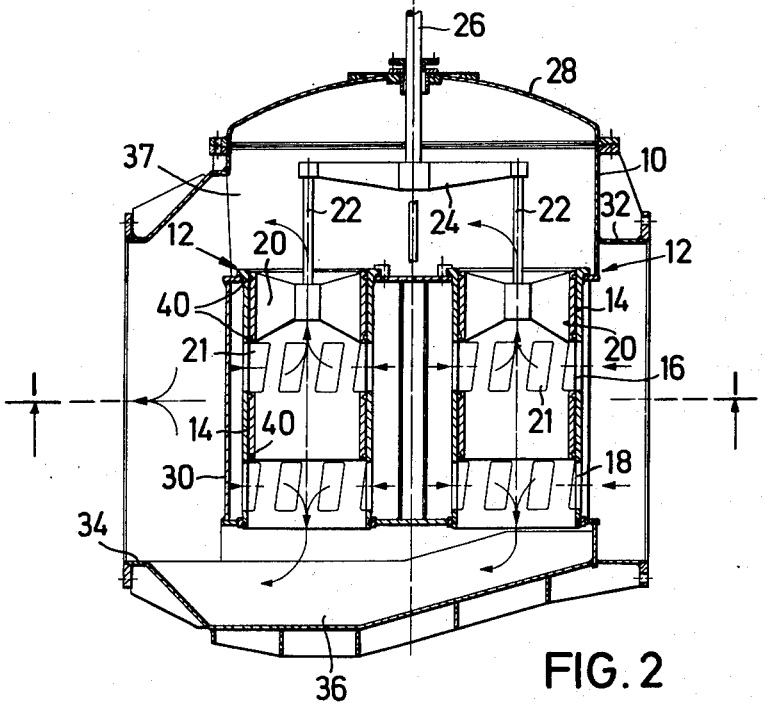
FIG. 2 is a vertical central sectional view of the same apparatus section being taken along line 2—2 of FIG. 1.

FIGS. 1 and 2 show control apparatus according to the invention which can be used, for example, for shutting off and regulating the combustion gas or air to be supplied to a blast preheater. By means of the control apparatus according to FIGS. 1 and 2, a single device of the illustrated type replaces two of the devices used in the past, which were provided in series with one another, one for opening or shutting off the flow of combustion gas and the other for regulating such flow. The former devices required a pair of drive means, while the new device can be operated by a single drive means. Also the earlier devices were applicable only within the distinct limitations as to the flow of combustion gas to be handled therein, whereas the new device is free of such limitations.

According to the invention and as shown in FIGS. 1 and 2, the new shutting off and regulating apparatus comprises a housing 10, containing four cylinder and slider units 12, each of these units consisting of an open ended cylinder 14 which as a cylinder wall with two axially spaced rows 16, 18 of circumferentially spaced slots extending through the cylinder wall. The open upper ends of cylinders 12 are disposed in an upper horizontal plane, and the open lower ends of these cylinders are disposed in a lower horizontal plane.

A slider 20 is fitted into the interior of each cylinder 14 for axial sliding therein, and is provided with a row of circumferentially spaced slots 21 having shapes and sizes similar to those of cylinder slots 16, 18. FIG. 2 shows the control apparatus as opened by superimposing slots 21 of slider 20 with all upper slots 16 of cylinders 14, while the lower edge of slider 20 lies above all lower rows 18 of slots in cylinders 14; in this position all slots are open. Sliders 20 are uniformly suspended from lifting rods 22. These in turn depend from outer ends of a system 24 of cross bars, centrally suspended from a lower end of a lifting rod 26 which can be raised or lowered by a drive motor (not shown). When rod 26 and sliders 20 thereon are lowered, the parts of sliders 20 around slots 21 progressively cover the two rows 16, 18 of slots in the cylinders, and finally shut off the entire system of slots.

Separating wall means 30 are disposed in housing 10 about the several cylinders 14 in such a way that rows of slots 16, 18 of cylinders 14 communicate with one connector 32 on housing 10, for example with an inlet 32 for combustion gas. A guide wall 33 is shown as being provided for guiding the flow of air in connector 32, to feed equal amounts of air to the several, symmetrically distributed cylinders in housing 10. A second connector 34 of the housing 10 communicates with the interiors of the several cylinders 14, whereas wall means 30 separates them from inlet connector 32. Connector 34 can be provided with guide wall means 35, for evenly guiding the flows of gas from the several distributed cylinder slider units 14.

For sealing the ends of cylinders 14 against outer surfaces of sliders 20, sealing rings are provided as schematically shown at 40. Housing 10 has a cover 28 which can be removed for replacement of seal rings 40 and if necessary also for replacement of sliders 20 or of cylinders 14 or of both. Such replacement accordingly is simple and can be performed rapidly. This applies particularly if all cylinders 14 and all sliders 20 have uniform dimensions for the entire housing 10, or desirably for the several housings 10 fo the entire preheating control system, thereby making it possible to keep the apparatus in proper working order with a minimum of storage of replacement parts.

The new control housing 10 may contain any desired number of the uniformly dimensioned cylinders 14 and of the sliders 20 fitting into the same, although four of them have been shown in FIGS. 1 and 2. Thus, dependent on the required amounts of flow to be handled, suitable total areas of slot apertures 16, 18 can be provided for shutting off and opening as well as regulating the larger or lesser flows of combustion bas by means fo uniform cylinders 14 and sliders 20. Similarly, new control housings 10 can be adapted to the needs of the lines for cold blast, hot blast, and flue gas.

In the operation of the control apparatus according to FIGS. 1 and 2, combustion gas enters housing 10 through connector 32, and separator wall means 30 leads all of this entering combustion gas, and only the same, to the several slots in rows 16, 18 of the several cylinders 14. If sliders 20 are in such position as to widely open all or part of these slots in the cylinder slider system 12, the combustion gas passes unrestrictedly through the slots and the interior of the cylinders and sliders into upper and lower end parts 36, 37 of housing 10 and through connector 34 to the preheater. By lowering sliders 20 part of their downward stroke, the flow of combustion gas can be regulated. By lowering the sliders all the way, this flow of gas can be shut off.

Figure 3:
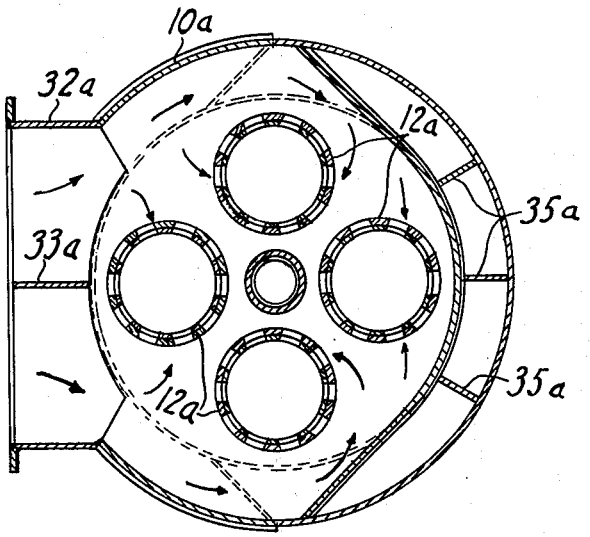
FIG. 3 shows another embodiment of the invention in a view corresponding to FIG. 1.
Figure 4:
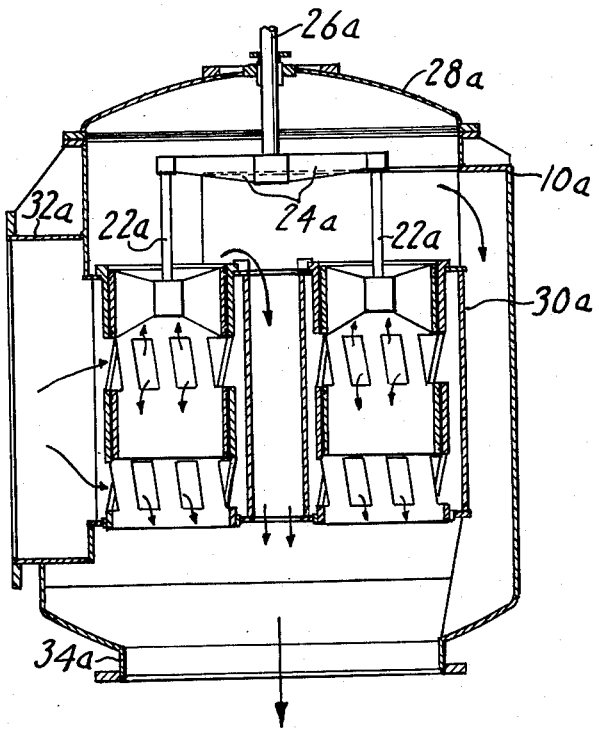
FIG. 4 shows this other embodiment in a view corresponding to FIG. 2.

FIGS. 3 and 4 show generally similar embodiments of the invention but shown the outlet connector **34*a* as axially disposed on the housing 10*a*, instead of the straight through connection shown in FIGS. 1 and 2. Regardless of such modifications the embodiments of FIGS. 1 to 4 provide full control over the flow of combustion gas by a single control housing 10 or 10*a*, instead of the two or three housings used in the past, one for admitting or closing and the other for regulating the incoming flow of gas. A single motor (not shown) is sufficient for operating the single drive shaft 26 or 26*a* of the single housing 10, 10*a*.** For different speeds of a shutting off operation and of the regulating operations it is possible to provide this shaft with a plurality of motors, including a rapid traverse motor (not shown) for rapid shutting off.

When used in the line for control of the cold blast to be heated in the preheater, the new control device can replace three of the usual control devices: one for controlling the filling up operation; one for regulating the cold blast flow; and one for shutting off the cold blast flow. The device of FIGS. 3 and 4 is specially applicable for these purposes.

The new device, as mentioned, can also control, among other things, the flue gases from the preheater. In this case, again, a single device according to the invention replaces two of the former devices (the shutting off and the regulating controls) or three of them (when the preheater is discharged into the flue gas line). In each of these applications the control device for the preheater system of a blast furnace can use uniform cylinder slider units 12, for the control of the various flows of gas or air in the system. Of course it may be desirable to utilize different sizes and different forms of housings **10, 10*a*, with different numbers of uniform cylinder slider units 12** in them, dependent on the arrangement and sizes of the several flow lines.

Figure 6:
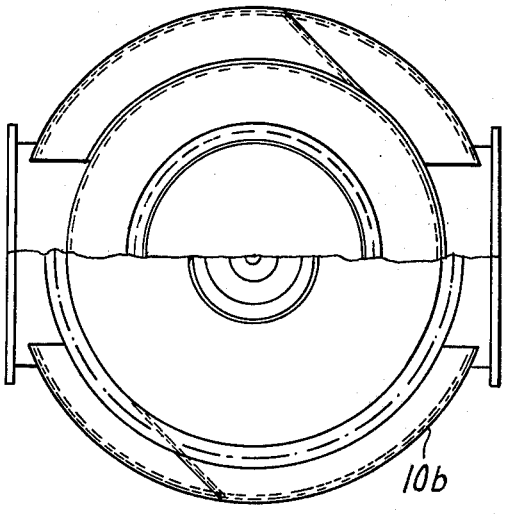
FIG. 6 shows in the lower half a plan view of the embodiment of FIG. 5 and in the upper half a bottom view of this embodiment.
Figure 5:
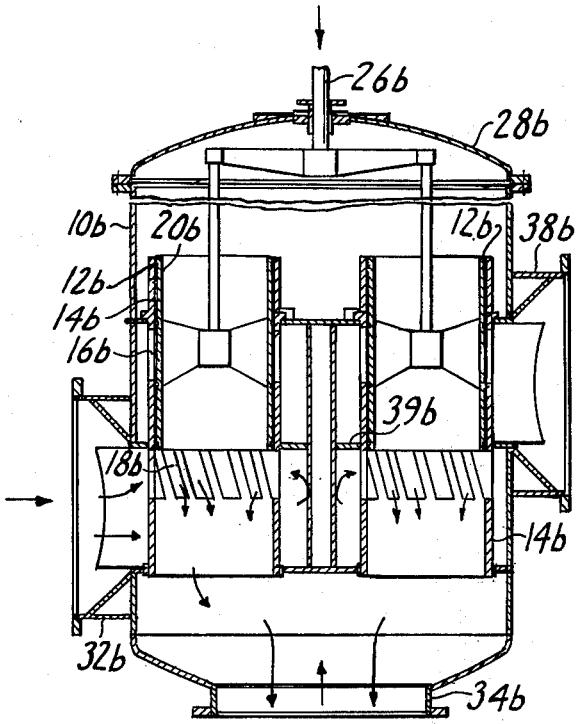
FIG. 5 shows a third embodiment of the invention in a view corresponding to FIGS. 2 and 4.
Figure 7:
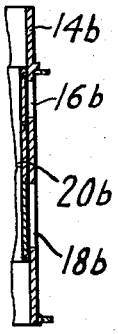
FIG. 7 shows a detail from FIG. 5 in a third position of the apparatus.

FIGS. 5 to 7 show a third embodiment of the invention which has the particular advantage that it allows a single housing 10b to be constructed so as to allow the new combination of slotted control cylinders **14*b* and control sliders 20*b* therein to control (that is, to shut off or open or regulate) the fluid flows of a plurality of lines connected to the preheater. For example, this embodiment can control the flue gas and cold blast lines of a preheater. The housing 10*b* has separating wall 39*b* mounted therein to separate a part of the housing, around the upper rows 16*b*, from a lower part around the rows 18*b* of control slots of the several cylinders 14*b*. Housing 10*b* has a connection 34*b* to the preheater; a second connection 32*b* for the source of cold blast; and a third connection 38*b* for the flue gas. By means of a separator wall 39*b*, connector 32*b*, communicates only with the lower rows 18*b* of slots, while connector 38*b* communicates only with the upper rows 16*b* of slots. The third connector 34*b* interconnects the preheater with the open, lower axial ends of cylinders 14*b*. When sliders 20*b* are in the raised position, as shown on the left hand of FIG. 5, cold air from connector 32*b* passes through the lower rows 18*b* of slots to the preheater connector 34*b*. When sliders 20*b* are in the lower position, as shown on the right hand of FIG. 5, flue gas from the preheater connector 34*b* into connector 38*b*, through the upper rows 16*b* of slots. In an intermediate position of slider 20*b*, illustrated in FIG. 7, control housing 10*b* is entirely closed as the sliders 22*b* therein cover and close both systems of rows of slots 16*b* and 18*b*.**

Figure 8:
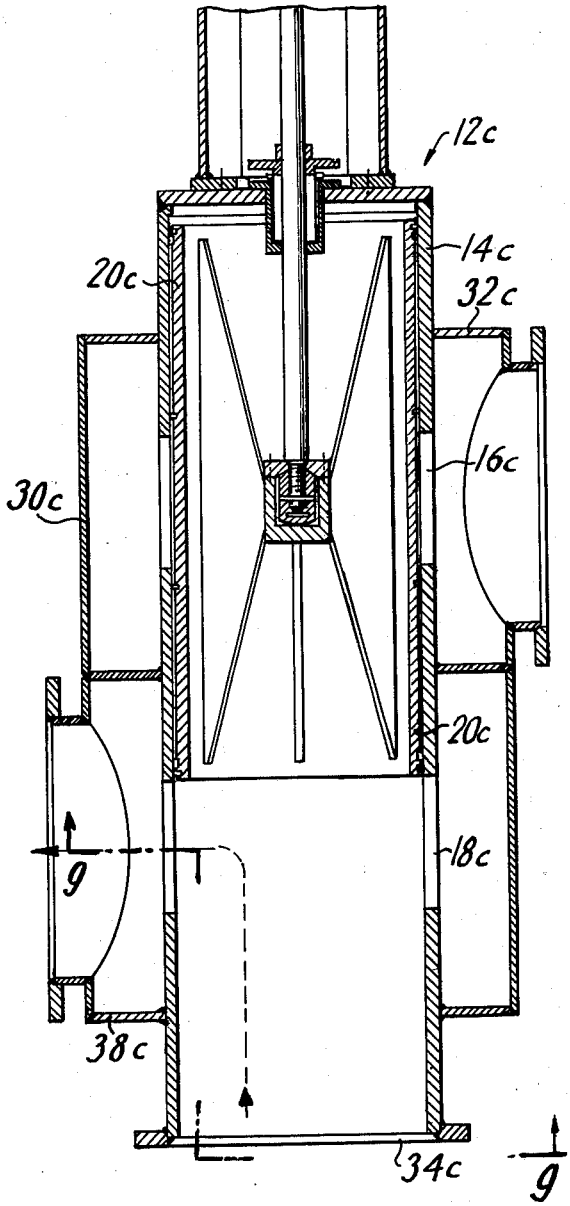
FIG. 8 shows a fourth embodiment of the invention in a view generally corresponding in FIGS. 2, 4 and 5, showing different positions of the apparatus in the right and left parts of FIG. 8.
Figure 9:
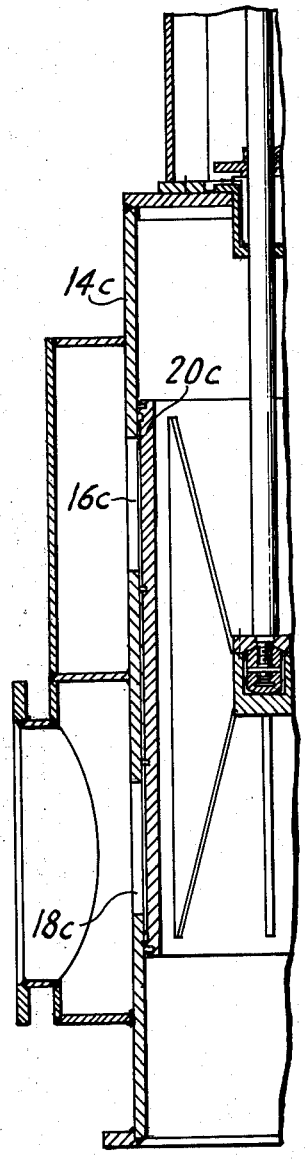
FIG. 9 shows a detail from FIG. 8 in a third position of the apparatus.
Figure 10:
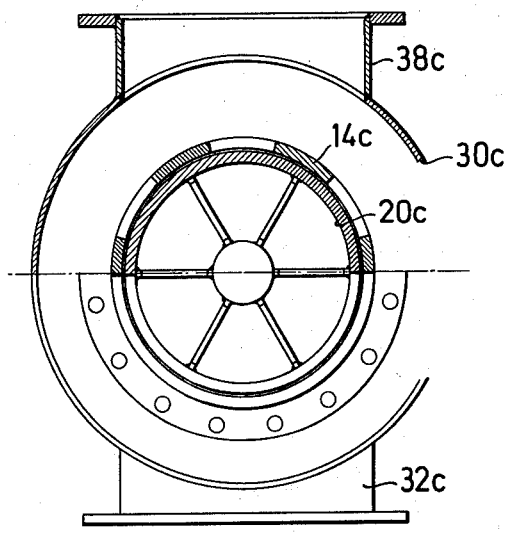
FIG. 10 is a bottom view, partly in section, of the apparatus of FIG. 8, the section being taken along lines 10—10 of FIG. 8.
Figure 11:
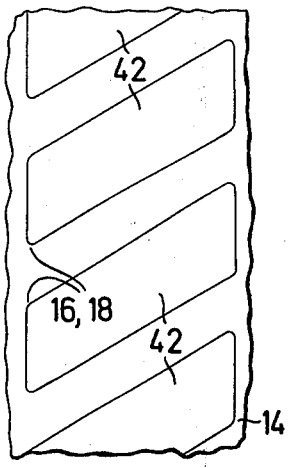
FIG. 11 shows a detail from FIG. 2.
Figure 12:
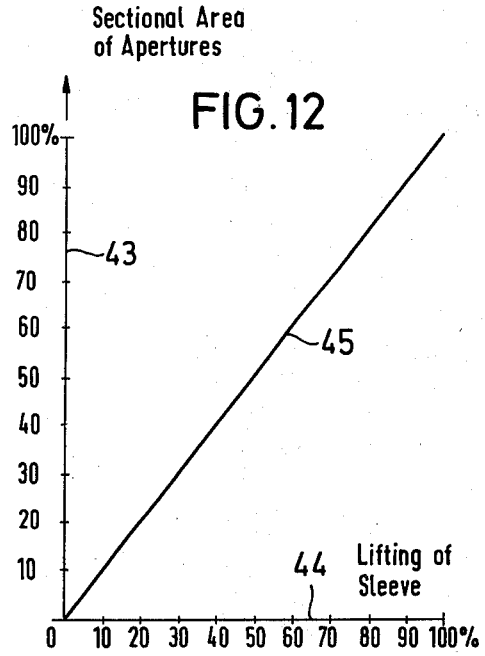
FIG. 12 is a diagram of a linear regulation characteristic obtainable by means of apparatus of the type indicated in FIG. 11.

FIGS. 8 to 10 illustrate a smaller variant of FIGS. 5 to 7, having only a single combination of a cylinder **14*c* and a slider 12*c*. These figures also show the different connectors 32*c*, 38*c*,** in slightly modified positions, but it will be appreciated that this is another embodiment which allows a plurality of flow control functions, for example for filling up of the preheater with air and for discharging air therefrom, as required, respectively, at the end of a heating up operation and before the start of a new heating up operation.

Figure 13:
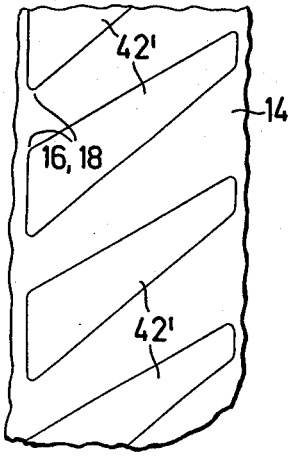
FIG. 13 shows a modification of FIG. 11.
Figure 14:
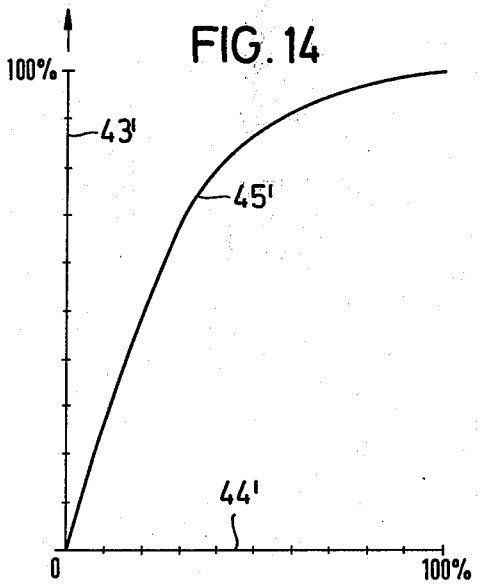
FIG. 14 is a diagram of a nonlinear regulating characteristic obtainable by means of apparatus as indicated in FIG. 13.

Referring finally to FIGS. 11 to 14, it will be seen that the individual slots 42 of the axially spaced rows of slots 16, 18 can be formed with mutually parallel edges, to provide a linear regulating characteristic curve 45 (FIG. 12), representing the effective areas of apertures 42 on the vertical coordinate 43 and the different degree of lifting of the closing and regulating sleeve 20 (FIGS. 1 and 2) on the horizontal coordinate 44. FIGS. 13 and 14 by contrast show a modified from of slots 42' with non-parallel edges, leading to a nonlinear regulating characteristic line 45'.

It will be understood that each of the elements described above, or two or more together, may also find a useful application in other types of control apparatus for air blast preheaters differing from the types described above.

While the invention has been illustrated and described as embodied in control apparatus for air blast preheaters, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. Valve control apparatus for air blast preheaters comprising: a housing having a first opening for admitting gas into the housing and a second opening for the exit of the gas; a plurality of double open-ended stationary cylinders mounted in said housing by sealing means which permit passage of gas from both open ends of the cylinders to the second opening in the housing; each said cylinder formed with a plurality of axially spaced rows of circumferentially spaced slots extending through the cylinder wall and connecting with the first opening; a corresponding plurality of side-by-side axially movable double open-ended valve cylinders, each close fitted within each said stationary cylinder and formed with a row of circumferentially spaced slots extending through the movable cylinder wall, the slots in each stationary cylinder and the slots in the respective movable cylinder forming coincident ports for the passage of gas at one setting of said movable cylinder; and power means for moving the movable cylinders within the respective stationary cylinders to cause misalignment of the slots and thereby cut off passage of gas between the first and second openings of the housing, with the power means including a single drive shaft that is coupled to the plurality of side-by-side movable cylinders for simultaneous axial motion.

2. Valve control apparatus according to claim 1 wherein each said stationary cylinder is formed with two axially spaced rows of circumferentially spaced slots extending through the cylinder walls.

3. Valve control apparatus as in claim 1 wherein said slots in the stationary and movable valve cylinders have mutually parallel edges.

4. Valve control apparatus as in claim 1 wherein said slots in the stationary and movable valve cylinders have opposite edges inclined relative to each other.

5. Valve control apparatus for air blast preheaters comprising: a housing having a first opening for admitting gas into the housing and an second opening for the exit of the gas; a plurality of double open-ended stationary cylinders mounted in said housing by sealing means which permit passage of gas from both open ends of the cylinders to the second opening in the housing; each said cylinder formed with a plurality of axially spaced rows of circumferentially spaced slots extending through the cylinder wall and connecting with the first opening; a corresponding plurality of side-by-side axially movable double open-ended valve cylinders close fitted within each said stationary cylinders, each formed with a row of circumferentially spaced slots extending through the movable cylinder wall, the slots in each stationary cylinder and the slots in the respective movable cylinder forming coincident ports for the passage of gas at one setting of said movable cylinder; and power means for moving the movable cylinders within the respective stationary cylinders to cause misalignment of the slots and thereby cut off passage of gas between the first and second openings of the housing.

6. Valve control apparatus as in claim 1 wherein each said stationary cylinder is formed with two axially spaced rows of circumferentially spaced slots extending through the cylinder walls.

7. Valve control apparatus as in claim 5 wherein said slots in the stationary and movable valve cylinders have mutually parallel edges.

8. Valve control apparatus as in claim 5 wherein said slots in the stationary and movable valve cylinders have opposite edges inclined relative to each other.

* * * * *